US008317182B2

(12) United States Patent
Probst

(10) Patent No.: US 8,317,182 B2
(45) Date of Patent: Nov. 27, 2012

(54) METHOD FOR CONTROLLING A PAPER-PROCESSING MACHINE

(75) Inventor: Thomas Probst, Kestenholz (CH)

(73) Assignee: Mueller Martini Holding AG, Hergiswil (CH)

( * ) Notice: Subject to any disclaimer, the term of this patent is extended or adjusted under 35 U.S.C. 154(b) by 22 days.

(21) Appl. No.: 12/844,334

(22) Filed: Jul. 27, 2010

(65) Prior Publication Data

US 2011/0029135 A1 Feb. 3, 2011

(30) Foreign Application Priority Data

Jul. 31, 2009 (EP) ..... 09166995

(51) Int. Cl.
*B65H 39/00* (2006.01)

(52) U.S. Cl. ..... 270/52.18; 270/52.16; 270/58.07; 270/58.29; 270/52.29

(58) Field of Classification Search ..... 270/52.02, 270/52.04, 52.16, 52.18, 52.29, 58.02, 58.03, 270/58.07, 58.08, 58.09, 58.29; 700/275, 700/304

See application file for complete search history.

(56) References Cited

U.S. PATENT DOCUMENTS

| | | | | |
|---|---|---|---|---|
| 3,902,708 | A | 9/1975 | Wise et al. | |
| 4,923,189 | A * | 5/1990 | Nail | 270/52.04 |
| 5,083,281 | A | 1/1992 | Rabindran et al. | |
| 5,314,566 | A * | 5/1994 | Gallagher et al. | 156/441.5 |
| 5,326,209 | A | 7/1994 | Duke | |
| 7,677,543 | B2 * | 3/2010 | Gulbrandsen et al. | 270/52.22 |
| 7,731,167 | B2 * | 6/2010 | Prim et al. | 270/52.22 |
| 2003/0094107 | A1 | 5/2003 | Asai et al. | |
| 2005/0285323 | A1 * | 12/2005 | Gulbrandsen et al. | 271/9.11 |
| 2009/0189339 | A1 | 7/2009 | Ohishi et al. | |

FOREIGN PATENT DOCUMENTS

| | | | |
|---|---|---|---|
| EP | 0 810 484 | A1 | 12/1997 |
| EP | 1 332 891 | A1 | 8/2003 |
| EP | 1 918 232 | A1 | 5/2008 |
| WO | WO-2008068007 | A8 | 7/2009 |

OTHER PUBLICATIONS

European Search Report dated Jan. 12, 2010, issued in priority European Patent Application No. 09 16 6995, and an English-language translation.

Notification under Article 94(3) PCT issued in counterpart European Application No. 09 166 995.2 dated Sep. 24, 2012.

* cited by examiner

*Primary Examiner* — Leslie A Nicholson, III

(74) *Attorney, Agent, or Firm* — Venable LLP; Robert Kinberg; Ryan M. Flandro

(57) ABSTRACT

A method is provided to control a paper-processing machine. Following an occurrence of at least one error, the error is automatically detected with at least one detection device. Following the detection of the error, a measure is automatically introduced to counteract the error. The measure is then canceled at least in part if the error no longer occurs or the machine is stopped completely if the error is still detected by the detection device following completion of a predetermined criterion.

14 Claims, 4 Drawing Sheets

METHOD FOR CONTROLLING A PAPER-PROCESSING MACHINE

CROSS-REFERENCE TO RELATED APPLICATION

This application claims the priority of European Patent Application No. 09166995.2, filed on Jul. 31, 2009, the subject matter of which is incorporated herein by reference.

BACKGROUND OF THE INVENTION

The invention relates to a method for the control of a paper-processing machine, wherein following the occurrence of at least one error, the error is detected automatically with the aid of at least one detection device, so that the error can be corrected.

Paper-processing machines, for example inserters, gathering machines, or gathering and wire-stitching machines, are comparatively complex machines and include different stations. These machines are operated at high capacities and the stations frequently have separate drives. An inserter, for example, can comprise many feeding stations which respectively function to withdraw one sheet from a stack and which can supply this sheet to a conveying device with pockets.

It is therefore not possible to avoid errors and malfunctions at times, for example if no sheet is withdrawn from a stack which is also referred to as missed withdrawals, or withdrawal errors. If such missed withdrawals occur successively at a feeder operating at full production speed, it is referred to as a series error. The number of missed withdrawals which result in a series error can generally be preset.

An alarm is triggered in the event that a series error occurs and the machine is then stopped in a controlled manner. A sensor for missing sheets is used to detect the missed withdrawals. The sensor may be arranged in front of the withdrawing device as seen in withdrawing direction. Once the machine is stopped, the plant operator must inspect the feeder causing the problem. The sheets that may be responsible for the interference are removed manually and new adjustments may be required, whereupon the machine must be restarted.

The complete shutdown of the paper-processing machine and/or the feeder results in numerous incomplete as well as unusable products which must be transferred out or completed during the further course of the processing. The necessary correction of these errors requires time and causes an essential reduction in the net output of a machine. In addition, the resumption of production is a very critical process which can frequently result in further interruptions. Machines in where errors can occur, in particular series errors that require a machine stop, can include trimmers, cross-stackers, bundle delivery machines, transport devices or other paper-processing machines.

SUMMARY OF THE INVENTION

It is therefore an object of the present invention to provide a method of the aforementioned type which makes it possible to correct the aforementioned disadvantages, at least in part. The method should make it possible to increase the net output of a paper-processing machine and to reduce the amount of unusable printed products that are generated.

The above and other objects are accomplished according to the invention by the provision of a method to control a paper-processing machine having a machine speed, which in one embodiment includes the steps of: following an occurrence of at least one error, automatically detecting the error with at least one detection device; following the detection of the error, automatically introducing a measure to counteract the error; and one of cancelling the measure at least in part if the error no longer occurs or stopping the machine completely if the error is still detected by the detection device following completion of a predetermined criterion.

According to a further embodiment of the invention, the machine includes an apparatus to support a self-repair operation, and the introducing step includes correcting the error utilizing the self-repair operation as the measure to counteract the error.

With the method according to the invention, a measure to counteract the error is thus initially taken when a series error occurs. The machine consequently is not stopped immediately, as has always been the case until following the detection of an error and/or a series error. With fast-running machines such as inserters, several seconds are required to stop machines that operate at speeds reaching up to 50,000 cycles/h. During this shut-down period, more than 40 faulty print products can be generated. Instead, the machine is now given the opportunity to take counter measures following a series error, during the time required for stopping the machine, so that the error can be corrected without triggering an alarm. Taking such a counter measure precludes a manual intervention and involves, for example, the reduction in the machine speed. Other optional measures involve, for example, blowing compressed air into a sheet stack deposited in the magazine for a feeder and activating mechanical devices to cause the vibration or oscillation of machine component, wherein these measures can also be combined.

It has turned out that following such a measure, the error in many cases does not occur again after a short period of time and is thus corrected by the machine itself without triggering an alarm, having to shut down the machine completely, or having to correct the error manually. On the one hand, this self-repair aspect may be triggered by reducing the machine speed. For example, if the production speed is cut in half, a suction device on a withdrawing device has twice as much time for building up the vacuum. On the other hand, as a result of the up to 40 continued withdrawing attempts during the slowing down of the machine, the sheet stack is moved by the withdrawing device or is at least shaken up. The probability that printed sheets can again be withdrawn therefore increases considerably. An intervention by the operator is not necessary with a self-repair, thereby providing considerable relief for the respective person. With large installations, it is therefore possible to avoid overloading an operator, as has been the case at times until now because of relatively large distances between the individual stations of a machine that cause the interference and the frequent searches for errors.

However, the machine must be shut down if the error cannot be corrected through self-repair within the time interval specified for the criterion, despite the automatic measure that is taken. The aforementioned criterion, for example, refers to a changeable time interval or a number of machine cycles stored in a control unit of the machine. The machine is stopped, for example, if the error is not corrected after five machine cycles, wherein the number of machine cycles generally is in the range of 1 to 15 cycles.

The machine speed may be increased again to the original machine speed if the error is corrected within the aforementioned criterion. However, it is also conceivable that the machine speed is initially not increased to the original machine speed, so as to avoid the probability of a repeated occurrence of the same error. The speed can be increased at a later time to the original machine speed, if necessary, wherein a gradual increase in particular may also be possible.

According to another embodiment, a machine station such as a feeder may be switched to a crawl speed following the detection of an error. The station speed in that case is no longer synchronized with the speed of the basic machine. Following a self-repair, the station may again be accelerated and the speed synchronized with that of the basic machine. Using such an extremely slow movement is an attempt to correct the problem, for example the incorrect withdrawal of a printed sheet. If the attempt succeeds in correcting the error, then the station speed may be again synchronized with the speed of the basic machine which has also slowed down in the meantime.

A sensor which detects missing withdrawals on a feeder can be used as means for detecting the error. The sensor may be arranged behind a withdrawing device, as seen in a withdrawing direction, thereby making it possible to securely determine whether or not a faulty withdrawal of the printed sheets takes place. The number of faulty or missed withdrawals can thus be detected with high certainty. However, other detection devices can also be used instead of a sensor, for example mechanical devices such as a tracing pin which can be used to detect faulty or missing withdrawals as well as double withdrawals.

According to yet another embodiment, statistical data may be collected in a control unit, e.g. during the operating period of the feeder, to determine how often series errors occur and how many series errors occur. The method can thus be essentially optimized and a further increase in the net output may consequently be possible.

BRIEF DESCRIPTION OF THE DRAWINGS

These and other features and advantages of the invention will be further understood from the following detailed description, with reference to the accompanying drawings, wherein.

DETAILED DESCRIPTION

Figure 1:
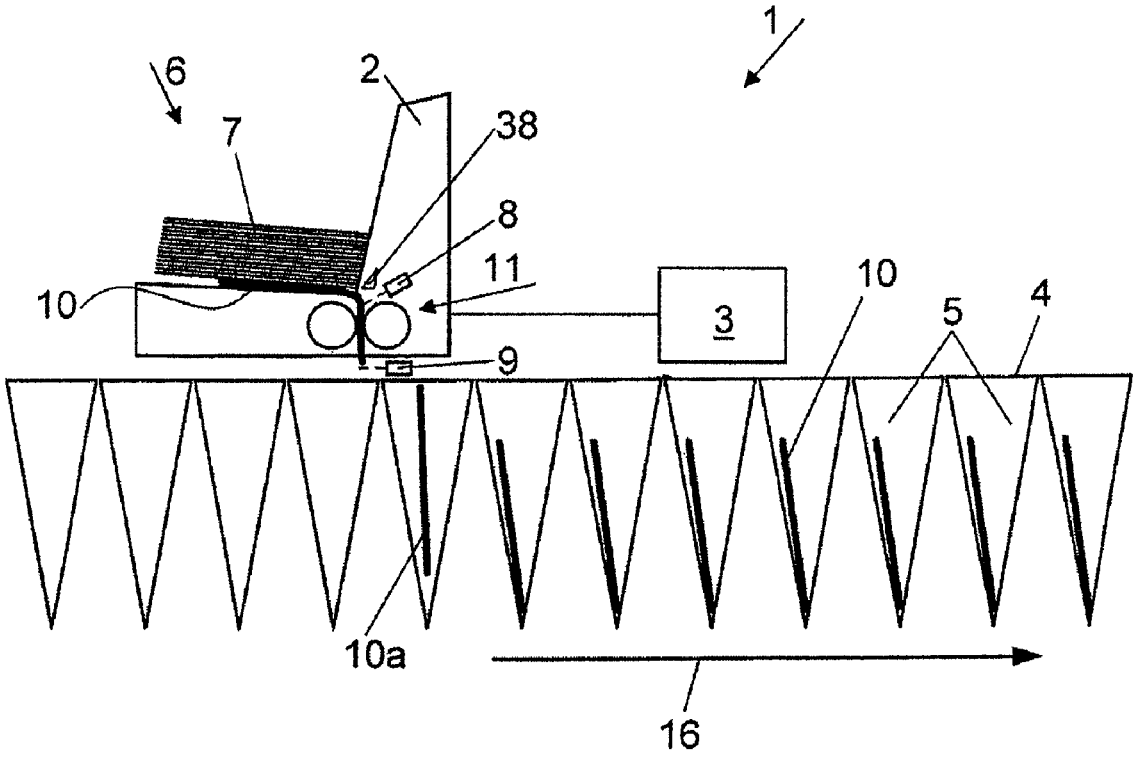
FIG. 1 is a schematic side view of a section of a paper-processing machine.

Referring to FIG. 1, there is partially shown a machine 1, which may comprise an inserter provided with at least one feeder 2 for withdrawing flexible, flat items, such as folded printed sheets 10, with the aid of a withdrawing device 11 from a stack 7 and to supply these items to a conveyor 4. The conveyor 4 may be provided with pockets 5 into which the printed sheets 10 are deposited. FIG. 1 shows a printed sheet 10*a* which has just been withdrawn from the stack 7 and is being deposited in a pocket 5. The deposited printed sheets 10 are conveyed in a conveying direction 16. As a rule, several such feeders 2 are provided which respectively function to deposit printed sheets 10 into the pockets 5. Printed sheets can thus be gathered and/or collected to form a printed product, e.g. a newspaper, a magazine or a book block. In place of the depicted conveyor 4 with pockets 5, other conveying devices can also be used which can comprise a gathering chain or can be provided with grippers.

The withdrawn printed sheets 10 are detected with the aid of a detection device 8 or 9, and the respective data may then be transmitted to a control unit 3. The detection device 9 may be provided and arranged, as can be seen, in the withdrawing direction after the withdrawing device 11. The detection device and/or 9 can be embodied as an optical sensor. However, other detection devices 8, 9 such as mechanical or electrical detection devices are conceivable as well. The feeder 2 can thus be provided with the first detection device 8 or the second detection device 9 or with both. With the aid of the detection devices 8 and 9, it is furthermore possible to determine whether a printed sheet 10 was withdrawn incorrectly or not at all. The sheets are withdrawn with the machine timing, for example using the withdrawing device 11 that is provided with suction devices which are not shown herein. These suction devices separate the lowest printed sheet 10 from the stack 7 so that it can be gripped by grippers or withdrawing rollers in a manner known per se and can by conveyed further.

The machine 1 shown herein with the feeder 2 and the conveyor 4 represents only one example of a machine station for which the method according to the invention can be used. In place of the feeder 2, other stations 6 can also be provided such as a product-label applicator, a trimmer for cutting book blocks or a stitching machine. The method according to the invention can furthermore also be realized with different types of machines 1, such as a cross stacker, a bundle delivery device, a gathering and wire-stitching machine, a collator and a perfect binder, wherein these machines can also be provided with known devices for detecting errors.

Until now, if a specific number of incorrect withdrawals and/or a series error were detected with the detection device 8 and/or 9 an alarm would triggered according to the prior art and the machine 1 stopped, thus lowering a machine speed M1 to zero. This case is shown with a curve 20 in FIG. 2. The y-axis in this case shows the machine speed M and the x-axis the time T. Incorrect withdrawals within a time interval 17 cause a series error, based on which the control unit 3 triggers an alarm for shutting down the machine 1. A time interval 24 indicates the time required for stopping the machine 1. Once the machine 1 is stopped, the feeder 2 is inspected during an interval 27 and the error is searched for and corrected. This time interval 27 depends on the type of error, but can be comparatively long and can last several minutes. It is conceivable that the feeder 2 must be replaced in case of more serious malfunctions which result in damage to components. The machine 1 is then restarted and accelerated until the original machine speed M1 is reached, wherein a time interval is required for the machine 1 to again reach the original speed M1. The faulty printed products generated during this interval 24 must be transferred out. The time required from the occurrence of series error until the original production speed is reached again, following a machine shutdown, is shown as a time interval 25.

Figure 2:
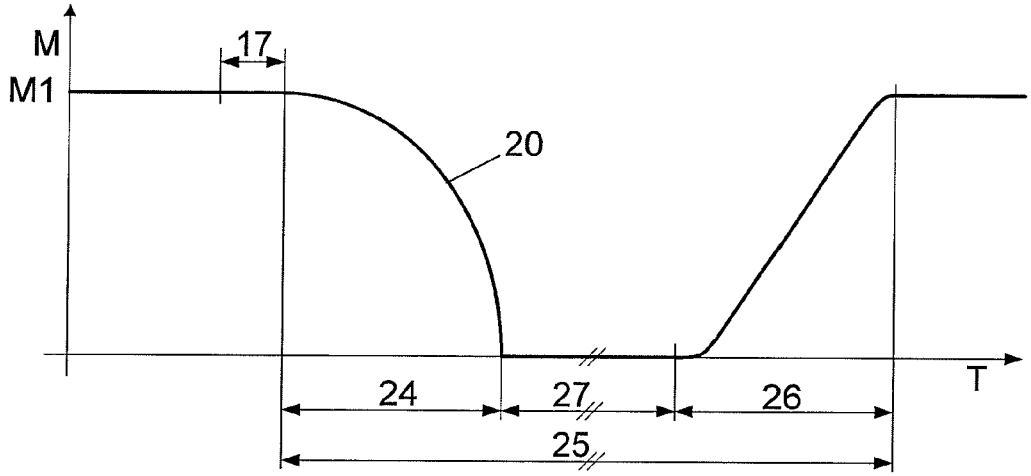
FIG. 2 PRIOR ART
FIG. 2 is a speed curve diagram illustrating shut-down and re-start of a machine following detection of an error, in accordance with the prior art.
Figure 3:
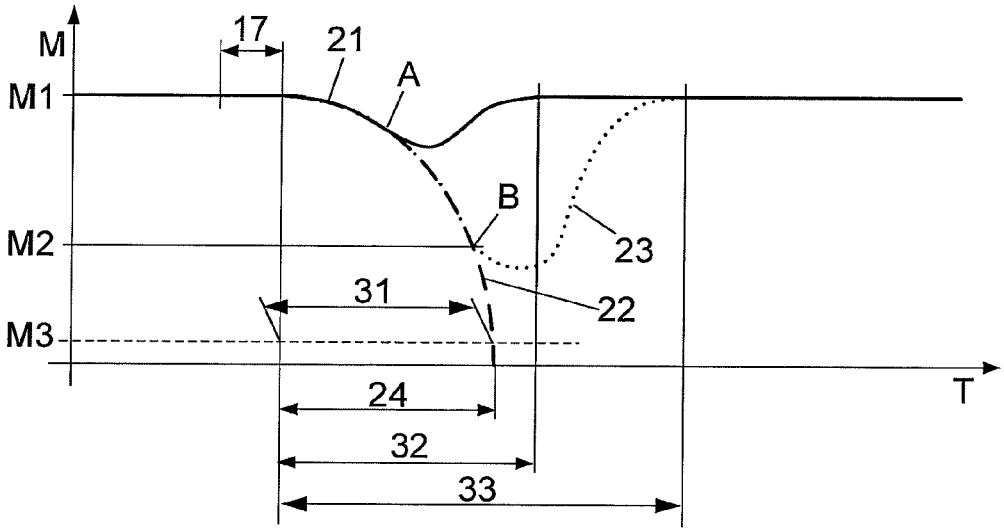
FIG. 3 is a speed curve diagram as shown in FIG. 2, but depicting the realization of a method according to the invention.

FIG. 3 shows that with the method according to the invention, the machine 1 is generally not stopped following the detection of a number of series errors during the time interval 17. Rather, the speed of the feeder 2 and that of the machine 1 is reduced in a manner preset by the control unit 3, as shown by the curve 21, in FIG. 3. For example, if it is determined at a point A on the curve 21 that the feeder 2 again withdraws the printed sheets 10 correctly as a result of a self-repair, the speed of the feeder 2 and the speed of the machine 1 are increased until the original machine speed M1 is reached once more. However, raising the machine speed can also occur at a later time, at a point B, if the self-repair occurs only later on, for example during a lower machine speed M2. If the error continues to be detected during a specified time interval 31, following the occurrence of the series error or with a predetermined low machine speed M3, then an alarm is triggered and the machine 1 is stopped completely, as shown with the dashed curve 22. In that case the machine must be inspected and the error corrected, as shown in FIG. 2 and described in the above. The machine 1 is subsequently again made operational according to FIG. 2. FIG. 3 shows the time interval 24 required for completely shutting down the machine 1. A time interval 32 is required to once more achieve the full production speed M1, following the occurrence of a series error, once it is determined at point A that the error has been corrected. A time interval 33 is required if it is determined at point B that the error has been corrected. In the event that a self-repair effect does not take place, the considerably longer period 25 is required, which is shown in FIG. 2, until the machine 1 is again operational and the machine speed M1 is reached. The criterion which determines a shutdown of the machine 1 can be a specific time interval, a clocking rate, or the reaching of a specific, minimum machine speed M3.

Instead of reducing the machine speed or in addition thereto, other measures can also be taken to support the self-repair effect. For example, an air nozzle can be used to blow air into a suitable region. FIG. 1 schematically shows that mechanical means 38 can also be activated, such as a device that can cause vibrations in a suitable region of the feeder 2. Alternatively, the suction effect of a suction device can also be increased or an additional suction device can be activated, wherein these measures are stopped as soon as no self-repair effect is detected within the criterion interval. Taking these measures will noticeably reduce the number of cases in which the machine 1 must be stopped completely following a series error, thus making it possible on the whole to increase the net output considerably. In particular, the net output can be increased if the machine speed must be lowered only briefly, as shown with the curve 21, meaning the speed M1 is reached again following a comparatively short period 32. If the speed is increased after point B, then the period 33 is longer, as shown with the curve 23, until the machine 1 has again reached the original machine speed M1. However, the interruption in the operation and the accumulating waste paper are still lower than in the case of a complete stoppage. In addition, no corresponding repair work or operator interventions are required.

Figure 4:
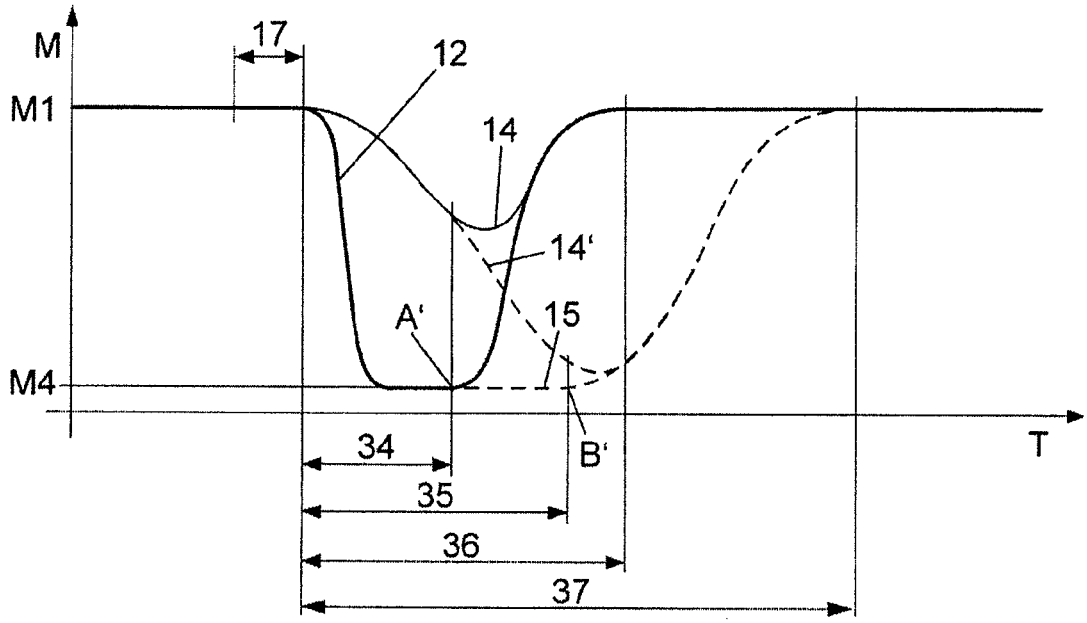
FIG. 4 is a speed curve diagram showing illustrating a variant of the method according to the invention for which a station of the machine is slowed to a crawl speed.

With the method according to FIG. 3, the operation of a station 6, for example the feeder 2, is synchronized with that of the basic machine 1. However, an asynchronous behavior between the station 6 and the basic machine 1 is also possible, as shown in FIG. 4, wherein the method is shown for the case of a self-repair. The curve 12 illustrates the speed course for the feeder 2 which changes to the crawl speed after a series error is detected. The feeder 2 operating at the crawl speed runs with a speed M4, for example at 1000 cycles/h. For this asynchronous behavior, the feeder 2 and the basic machine 1 must each be provided with a separate drive which can be a servo drive. A self-repair is detected at a point A', following a time interval 34. Subsequently, the machine speed of the feeder 2 and the speed of the machine 1 are again increased in accordance with the curves 12 and 14, respectively, until the starting speed M1 is reached once more. However, if is not determined until after a time interval 35 at point B'that the feeder 2 again withdraws correctly, the speed of the feeder 2 is thereafter increased according to the curve 15 and the machine 1 speed is again increased according to the curve 14' until the original speeds of the feeder and machine are attained. According to the curve 12, the speed of the feeder 2 is thus lowered considerably faster to a lower value M4 than the speed of the machine 1. As soon as the feeder 2 can again process the printed sheets 10 without error, its operation is synchronized with that of the machine 1. FIG. 4 shows that the synchronized behavior between the feeder 2 and the machine 1 is again restored prior to reaching the original machine speed M1. During the increase in the machine speed, the curves 14 and 12 coincide once more after the point A'. The curves 14' and 15 also coincide, meaning the feeder 2 and the machine 1 again operate synchronized and no further printed products must be transferred out. Switching the feeder 2 to the crawl speed, following a series error, furthermore strongly supports the self-repair effect. The production can thus be continued with the original machine speed M1 following a time interval 36 and/or which is considerably shorter than the time interval 25 according to FIG. 2.

The number of individual errors that result in a series error can be fixedly specified in the control unit 3 or can be changeable. The aforementioned measures to counteract an error are taken if the error continues to exist, for example following a corresponding number of missed withdrawals. For example, the machine speed is lowered if three missed withdrawals are detected. This number is preferably automatically adapted to an optimum value during the operation. Optimum value in this case means that the lowest possible number of faulty printed products is transferred out. However, the number of machine stops should also be low and the net output should be high. To adjust this optimum value for the value of the series error number, statistical data is collected via the control units 3 during the operational period of the feeder 2 in order to determine how often series errors occur as well as the number of series errors that occur. This statistical data can be used to determine the optimum number to be preset for the series errors.

Figure 5:
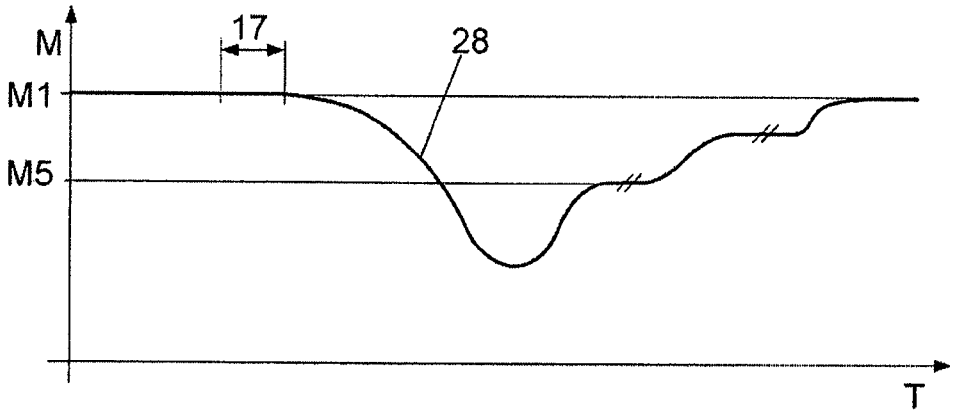
FIG. 5 is a speed curve diagram illustrating the course of the curve for a different variant of the method according to the invention for which the machine speed is gradually increased.

It is furthermore conceivable, according to a curve shown in FIG. 5, that following a successful self-repair the control unit 3 does not adjust the machine speed to the original value M1, but to a lower value M5 at which fewer interruptions occur. As a result, the number of transferred out, incomplete printed products could be reduced even further. If no missed withdrawals or only a few occur during the machine speed M5, the control unit 3 could gradually increase the speed and could thus search for an optimum value for the machine speed with respect to incomplete printed products and a high net output.

Figure 6:
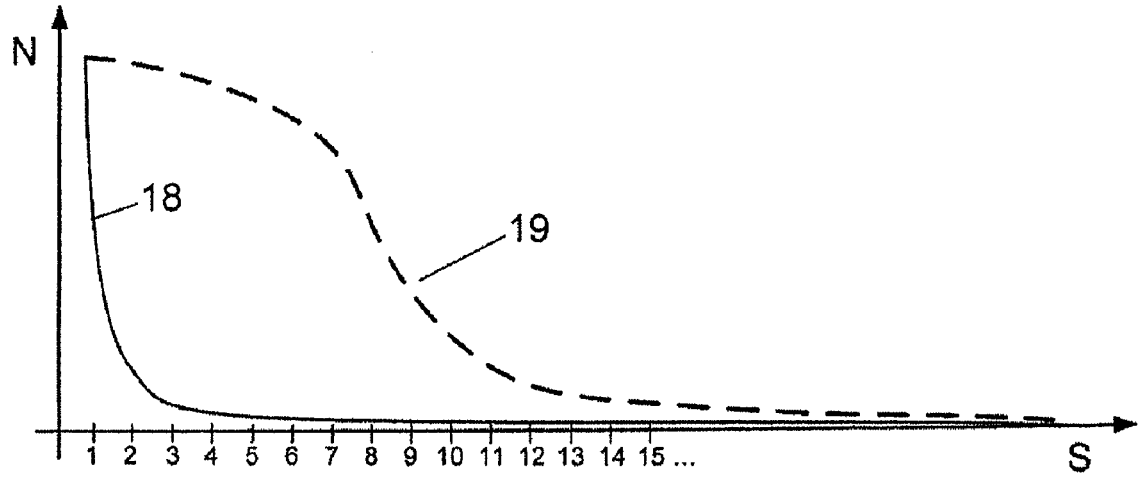
FIG. 6 is a diagram showing a representation of the number of series errors shown with the aid of two curves, corresponding respectively to a case A and a case B.

The diagram shown in FIG. 6, for example, represents two different error statistics. The series error number S is shown on the x-axis while the number N of the series errors is shown on the y-axis. A curve 18 represents the case for which in most cases the sheets are again processed correctly following one or two successively missed withdrawals. For example, the series error number in this case is adjusted for two. In the event that a printed product 10 cannot be processed, a measure corresponding to the error is triggered automatically after only two successive misses, thereby making it possible to use a self-repair effect that results in the lowest number of faulty printed products and does not require a machine shutdown.

In a second case shown with the curve 19, the sheets are obviously withdrawn correctly, but in part only after several successive incorrect withdrawals. In this second case, the selected series error number is selected to be higher than in the first case, for example it is adjusted for the value six. As a result, unnecessary machine stops can be avoided while an easy to comprehend number of faulty printed products are still generated and transferred out.

In both cases, it happens only rarely that following several missed withdrawals, a printed sheet 10 in a feeder cannot be gripped by the withdrawing device 11. This can occur, for example, if an attached suction device on the withdrawing device 11 is defective or has fallen off. In that case, the machine must be shut down for a manual intervention.

By automatically starting these measures, the method according to the invention makes it possible to correct errors other than those described above, such as the above-described missed withdrawals at the feeder 2. Of course, it is also possible to correct double withdrawals where two sheets are withdrawn jointly with the aid of self-repair measures using mechanical devices 38, such as the automatic insertion of additional separating devices or blowing air into the stack.

In one example implementing the method according to the invention, during an operating period of 3 hours, 35 series errors were detected in an arrangement using several feeders 2. In 28 cases, a self-repair effect occurred because of the briefly lowered machine speed. A complete machine stop was required only in 7 cases. An alarm had to be sounded correspondingly less often which relieved the user of unnecessary error searches. As compared to the prior art, the net output could be increased noticeably and the number of transferred out printed products could be reduced by introducing the respective measures following the detection of a series error and the subsequently triggered self-repair effect.

It will be understood that the above description of the present invention is susceptible to various modifications, changes and adaptations, and that the same are intended to be comprehended within the meaning and range of equivalents of the appended claims.

What is claimed is:

1. A method to control a paper-processing machine having a machine speed, comprising:

following an occurrence of at least one error, automatically detecting the at least one error with at least one detection device;

following the detection of the at least one error, automatically introducing a measure to counteract the at least one error, the measure comprising reducing the machine speed without stopping the machine; and wherein, following the introduction of the measure to counteract the at least one error, (a) if the at least one error is no longer detected by the at least one detection device following completion of a predetermined criterion, automatically cancelling the measure, or (b) if the error is still detected by the at least one detection device following completion of the predetermined criterion, automatically stopping the machine completely.

2. The method according to claim 1, wherein the at least one error is a series error.

3. The method according to claim 2, wherein the introducing of the measure to counteract the at least one error follows detection of a specific number of series errors.

4. The method according to claim 3, including optimizing the number of series errors as a result of a collection of statistical data.

5. The method according to claim 3, wherein the number of series errors corresponds to a number of missed withdrawals or double withdrawals of sheets from a feeder.

6. The method according to claim 1 , wherein the machine speed is reduced in accordance with a curve that is predetermined by a control unit.

7. The method according to claim 1 , wherein if the at least one error is no longer detected by the at least one detection device following completion of the predetermined criterion, accelerating the machine speed to an original machine speed.

8. The method according to claim 1, wherein the introducing step includes automatically activating a mechanical device as the measure to counteract the at least one error.

9. The method according to claim 1, wherein the step of introducing includes reducing the speed of a station of the machine to a crawl speed, and wherein, if the at least one error is no longer detected by the at least one detection device following completion of the predetermined criterion, accelerating the station and synchronizing the speed of the station with the machine speed.

10. The method according to claim 1, wherein the step of detecting includes detecting the at least one error in one of a feeder belonging to an inserter, a gathering machine or a gathering and wire-stitching machine.

11. The method according to claim 1, wherein the at least one detection device comprises at least one sensor.

12. The method according to claim 1, wherein the criterion comprises a time interval.

13. The method according to claim 1, wherein the criterion comprises a number of machine cycles.

14. The method according to claim 1, wherein the machine includes an apparatus to support a self-repair operation, and the introducing step includes correcting the error utilizing the self-repair operation as the measure to counteract the error.

* * * * *